US005397021A

United States Patent [19]

Usui

[11] Patent Number: 5,397,021

[45] Date of Patent: Mar. 14, 1995

[54] CRUSHABLE BEVERAGE CAN

[75] Inventor: Yoshio Usui, 14-15, Koenji Minami 1-Chome, Suginami-Ku, Tokyo-To, Japan

[73] Assignees: Yoshio Usui; Yuko Ishii, Tokyo, Japan

[21] Appl. No.: 276,770

[22] Filed: Jul. 18, 1994

Related U.S. Application Data

[63] Continuation of Ser. No. 972,979, Nov. 6, 1992, abandoned.

[30] Foreign Application Priority Data

Nov. 6, 1991 [JP] Japan ..... 3-290110
Jul. 2, 1992 [JP] Japan ..... 4-175548

[51] Int. Cl.[6] ..... B65D 1/40

[52] U.S. Cl. ..... 220/667; 220/672; 220/673

[58] Field of Search ..... 220/666, 667, 907, 6, 220/8, 9.2, 266, 276, 672, 673, 675; 215/14, 253

[56] References Cited

U.S. PATENT DOCUMENTS

| | | | |
|---|---|---|---|
| 781,939 | 2/1905 | Fulton | 220/667 X |
| 2,139,143 | 12/1938 | Wiswell | 220/667 X |
| 3,353,700 | 11/1967 | Kalina | 220/667 |
| 3,872,994 | 3/1975 | Hyde | 220/667 |
| 3,918,603 | 11/1975 | Hatada | 220/667 |
| 4,316,551 | 2/1982 | Belokin, Jr. | 220/667 |
| 4,324,340 | 4/1982 | Belokin, Jr. | 220/667 |
| 4,860,908 | 8/1989 | Rumble et al. | 220/667 |
| 4,872,576 | 10/1989 | Nakamura | 220/907 X |

FOREIGN PATENT DOCUMENTS

| | | | |
|---|---|---|---|
| 2316132 | 1/1977 | France | 220/907 |

*Primary Examiner*—Allan N. Shoap
*Assistant Examiner*—Stephen Cronin
*Attorney, Agent, or Firm*—Ladas & Parry

[57] ABSTRACT

A beverage can that is capable of crushing easily in the axial direction is provided. The beverage can is designed to contain a beverage and has a roughly circular cylindrical shape with, at a prescribed portion on one end surface thereof, an operational portion for forming a beverage-input port. A side wall of the can has a bellows-like structure provided with score lines.

6 Claims, 4 Drawing Sheets

CRUSHABLE BEVERAGE CAN

This is a continuation of application Ser. No. 07/972,979, filed on Nov. 6, 1992, now abandoned.

BACKGROUND OF THE INVENTION

The present invention relates to a crushable beverage can and, in particular, to a beverage can that has been designed to be easily crushed.

PRIOR ART

The cans that have become common as containers for substances such as refreshing drinks and alcoholic drinks have recently started to cause concern as an environmental problem because people throw them away after use, and there is a growing demand to make them crushable and thus easier to carry home.

PROBLEM TO BE SOLVED BY THE PRESENT INVENTION

Once one of these popular cans has been used to contain a substance such as a beverage, it contains nothing but air. Therefore, if it could be crushed, its transportation would be greatly simplified. In particular, if it could be crushed along its longitudinal axis, it would be even more convenient. An ordinary crushable beverage can is made of aluminum or steel. After an aluminum can has been used to contain a substance such as a beverage, it is comparatively easy to crush by squeezing it perpendicular to its side wall, but it is then virtually impossible to crush in the direction perpendicular to that, in other words in the axial direction. A steel can is difficult to crush by manual force anyway, and it is extremely rigid in the axial direction.

SUMMARY OF THE INVENTION

The present invention was conceived after consideration of the above point and has as its object the provision of a crushable beverage can that is capable of crushing easily in the axial direction thereof.

MEANS OF SOLVING THE PROBLEMS OF THE PRIOR ART

To solve the above problem, the present invention has as its objective the provision of a can designed to seal in a substance such as a beverage, wherein a side wall of the can is provided with a bellows-like portion and score lines are provided in ridge portions of the bellows-like portion.

The side wall of the crushable beverage can of the present invention is provide with a bellows-like structure with score lines on ridge lines thereof. Therefore, if a compressive force is applied in the axial direction of the can, the side wall of the can will rupture at the score lines and the bellows shape will collapse, so that it is possible to crush the can by manual force in such a manner that the dimension of the can in the axial direction can be reduced to a fraction thereof. In addition, this beverage can has a large resistance to forces applied in the radial direction.

EFFECT OF THE PRESENT INVENTION

As described above, since the side wall of a crushable beverage can of the present invention is provided with a bellows-like structure, it is possible to crush the can easily by the application of manual force along the axial direction of the can.

PREFERRED EMBODIMENT

Figure 1:
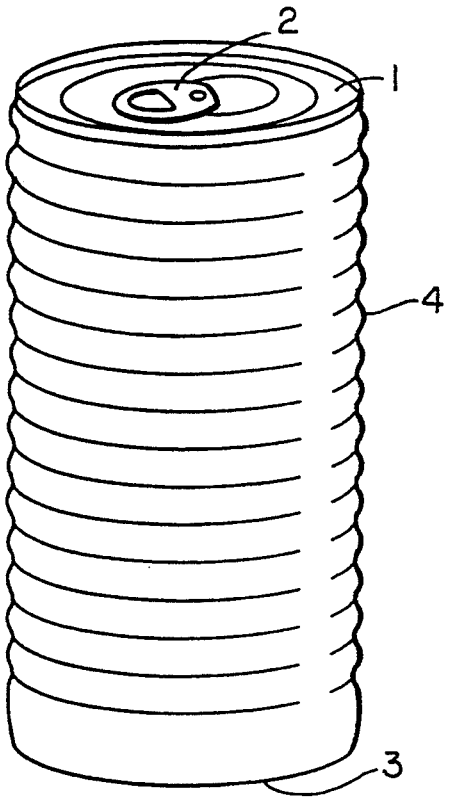
FIG. 1 is a perspective view of a first embodiment of the present invention.

FIG. 1 shows a first embodiment of the present invention. The entire body of the beverage can of this embodiment has a roughly circular cylindrical shape. A top surface 1 provided at one of the two ends of this cylinder is provided with a operational portion, or pull-tab 2, which opens a charging port for the contents such as a beverage. The other end of the cylinder is closed by a bottom surface 3 which is an end surface.

The side wall 4 of the can is formed as a bellows-like structure. Since the direction of the troughs of this bellows portion is aligned to follow the circumferential surface of the side wall, it is possible to crush the empty can in the axial direction by the application of a compression force applied in that direction.

The most practical method of forming this bellows portion is by pressing-this will give the ridges and troughs of the bellows portion a rounded configuration. Since the crushability of this beverage can is not determined simply by the wall thickness, it is possible to decide on the material of this can after consideration of various conditions such as manufacturing restrictions.

Figure 2:
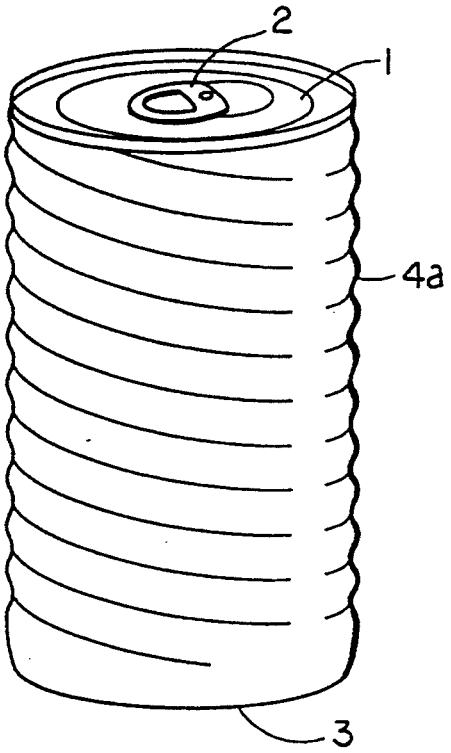
FIG. 2 is a perspective view of a second embodiment of the present invention.

FIG. 2 shows a second embodiment of the present invention wherein the bellows portion is formed in a helical configuration. In other words, the troughs of the bellows portion are at an angle to the axial direction of the beverage can. Therefore, the rigidity of this can in the axial direction is somewhat higher than that of the can of FIG. 1, and the can is also more rigid with respect to changes in shape during transportation.

Figure 3:
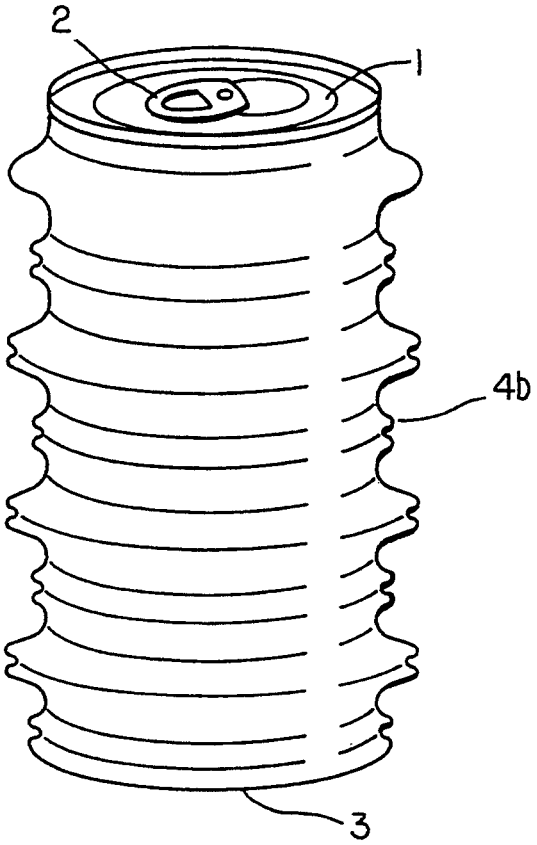
FIG. 3 is a perspective view of a third embodiment of the present invention.

FIG. 3 shows a third embodiment of the present invention wherein a bellows portion **4*b*** has a configuration such that a pattern of alternate deep troughs and shallow troughs is repeated. This configuration ensures that the side wall material of the deep-trough portions telescopes into the side wall material of the shallow-trough portions, increasing the degree of compression and thus making it easier to handle beverage cans that have been thrown away.

The combination of deep troughs and shallow troughs could also be configured as high ridges and low ridges. Since this configuration will ensure that the side wall collapses even more onto itself when subjected to a compressive force, crushing the can will make it an even more compact final shape, facilitating transportation.

Figure 4A:
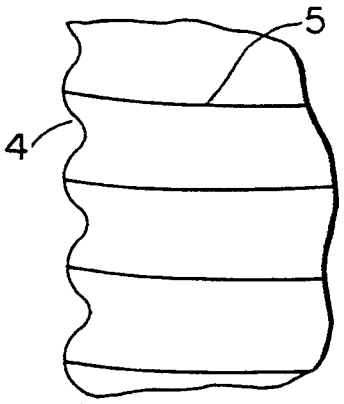
FIG. 4 is an explanatory view of score lines provided in a beverage can of the present invention.
Figure 4B:
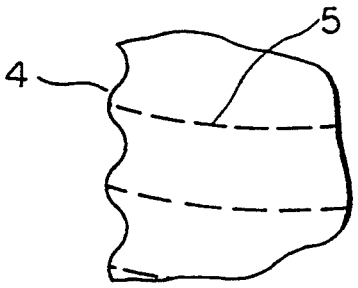

FIG. 4 shows a score line 5 provided in a ridge of the bellows portion of the can according to the present invention. This make the can crush more readily when it is subjected to a compressive force. The score line 5 could be a continuous line following along the ridge, as shown in FIG. 4(*a*), or it could be a discontinuous line, as shown in FIG. 4(*b*).

Figure 5:
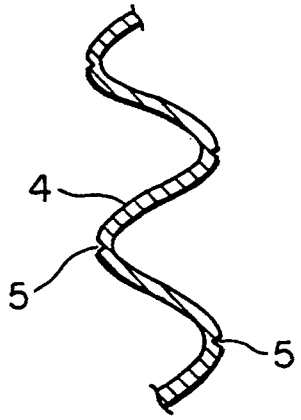
FIG. 5 is an enlarged cross-sectional view of a number of the score lines of FIG. 4.

FIG. 5 is an enlarged cross-sectional view of a number of the score lines 5 of FIG. 4. As shown in this figure, the score lines 5 are provided along the crests of the ridges of the bellows portion of the can. Note that these score lines 5 are provided along the crests of the ridges on either or both of the inner and outer surfaces.

Figure 6:
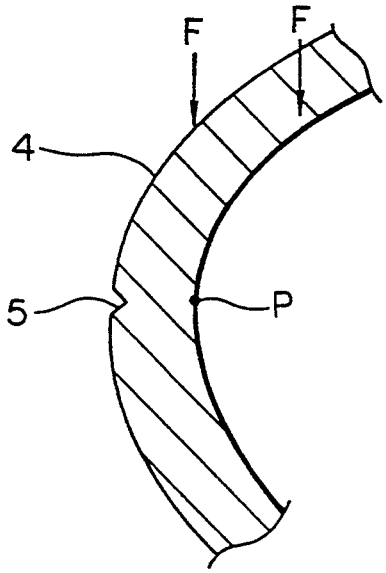
FIG. 6 is a further enlargement of one of the score lines of FIG. 5.

FIG. 6 is a further enlargement of one of the score lines 5 shown in FIG. 5. This score line is provided on a crest of the bellows portion provided in the side wall of the can. When the can is crushed, a force F that tends to push open the score line 5 is applied. This generates a force that acts to push open the score line, pivoting about the lowest point P of the concave part of the side wall of the can, and rupture the side wall, crushing the can.

Figure 7:
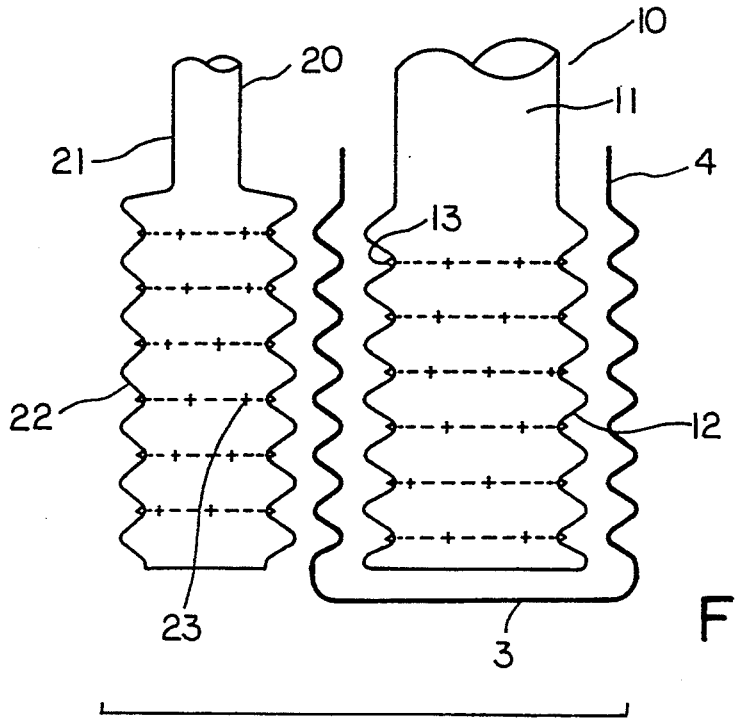
FIG. 7 is an explanatory view of a device for manufacturing a crushable can in accordance with the present invention.

FIG. 7 shows a beverage can of the present invention, together with rollers used to form this can. The can is shown in this figure as consisting of just the bottom surface 3 and the side wall 4. In particular, the forming of the side wall 4 is entrusted to two rollers 10 and 20.

The two rollers 10 and 20 are provided at the ends of rotational shafts 11 and 21, respectively, and are also provided with indentations 12 and 22 respectively. Mutual engagement of the indentations 12 and 22 shapes the material of the can by compression therebetween. Knife edges 13 and 23 are provided in the trough portions of the indentations in order to create score lines in the crests of the bellows portion of the can.

Figure 8:
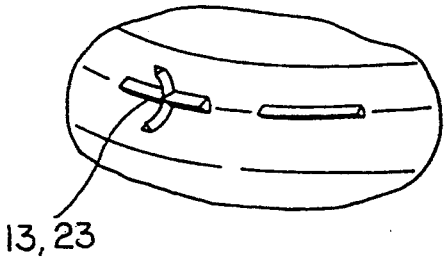
FIG. 8 is an explanatory view of the portion of the device of FIG. 7 that forms the score lines.

FIG. 8 shows the shapes of the knife edges 13 and 23. The knife edges 13 and 23 have portions that follow the line of the troughs and portions perpendicular thereto, and are arranged to create cross-shaped score lines in the score lines on the inner and outer sides of the can. The roller 10 is arranged on the inner side of the side wall of the can, and the other roller 20 is arranged on the outer side thereof.

Figure 9:
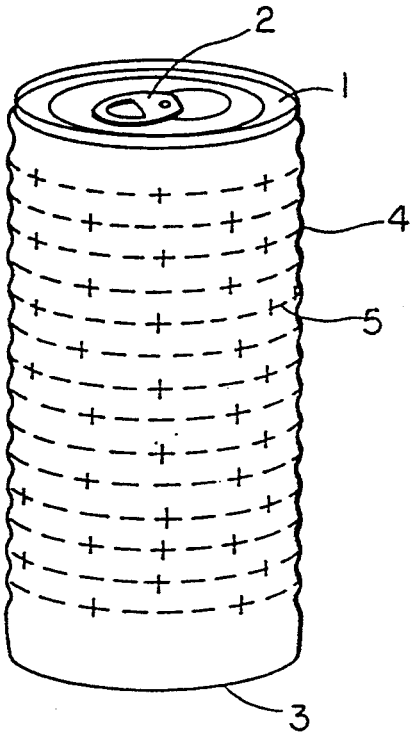
FIG. 9 is a view of the exterior of a can in accordance with the present invention.

FIG. 9 is a perspective view of the exterior of a beverage can press-formed by the device of FIGS. 7 and 8. As shown in the figure, score lines are provided not only in the circumferential direction of the can but also in the axial direction thereof. Therefore, when a compressive force is applied to the can in the axial direction thereof, the side wall of the can is subjected to forces applied both inward and outward in the radial direction and, as a result, the score lines are pushed open and the side wall of the can is ruptured along the score lines.

What is claimed is:

1. A crushable can for sealing in a substance, wherein a side wall of said can is provided with a bellows-like profile comprising outwardly extending ridges with outward ridge crests, said ridges being connected by inwardly extending ridges with inward ridge crests, said side wall having exterior and interior surfaces, score lines being provided on said side wall exterior surfaces of the outward ridge crests and on said side wall interior surfaces of the inward ridge crests.

2. A crushable can in accordance with claim 1, wherein said bellows-like profile comprises a combination of larger-diameter portions and smaller-diameter portions.

3. A crushable can in accordance with claim 1, wherein said bellows-like profile has a helical form.

4. A crushable can in accordance with claim 1, wherein said score lines are aligned along the axial direction of said can and also along a direction perpendicular to said axial direction.

5. A crushable can in accordance with claim 1, wherein said score lines consist of short lines at least some of which cross one another in cross-shaped patterns, said cross-shaped patterns being distributed around the can.

6. A crushable can in accordance with claim 1 wherein said score lines comprise first segments of otherwise unscored lines along the ridge crests, and said first score line segments are crossed by second score lines forming, with said first segments, cross-shaped score line patterns.

* * * * *